US007850028B2

(12) United States Patent
Morini

(10) Patent No.: US 7,850,028 B2
(45) Date of Patent: Dec. 14, 2010

(54) CHILD-PROOF CAPSULE WITH SECURITY STRIP

(75) Inventor: Emilio Morini, Colorno (IT)

(73) Assignee: Bormioli Rocco & Figlio S.p.A., Parma (IT)

( * ) Notice: Subject to any disclaimer, the term of this patent is extended or adjusted under 35 U.S.C. 154(b) by 394 days.

(21) Appl. No.: 10/513,144

(22) PCT Filed: May 2, 2002

(86) PCT No.: PCT/IT02/00286

§ 371 (c)(1),
(2), (4) Date: Nov. 2, 2004

(87) PCT Pub. No.: WO03/093129

PCT Pub. Date: Nov. 13, 2003

(65) Prior Publication Data

US 2005/0161425 A1 Jul. 28, 2005

(51) Int. Cl.
*B65D 55/02* (2006.01)

(52) U.S. Cl. ..... 215/220; 215/252

(58) Field of Classification Search ..... 215/276, 215/252, 219, 220

See application file for complete search history.

(56) References Cited

U.S. PATENT DOCUMENTS 3,944,102 A * 3/1976 Grau ..... 215/251
4,523,688 A * 6/1985 Puresevic et al. ..... 215/220
4,632,264 A * 12/1986 Evans ..... 215/220
5,280,842 A * 1/1994 Koo ..... 215/220
5,295,600 A * 3/1994 Kowal ..... 215/252
5,676,268 A 10/1997 King et al.
5,749,484 A * 5/1998 Trout ..... 215/219
6,372,167 B1 4/2002 Morini

FOREIGN PATENT DOCUMENTS

| | | |
|---|---|---|
| DE | 3300347 A1 * | 7/1984 |
| EP | 0 127 943 | 12/1984 |
| EP | 0 297 160 | 1/1989 |
| EP | 0 963 916 | 12/1999 |
| GB | 1 388 729 | 3/1975 |
| JP | 9-142505 | 6/1997 |
| WO | WO 97 10937 | 3/1997 |

* cited by examiner

*Primary Examiner*—Anthony Stashick
*Assistant Examiner*—James N Smalley
(74) *Attorney, Agent, or Firm*—Pearne & Gordon LLP

(57) ABSTRACT

The invention relates to a child-proof capsule with a security strip (12) the capsule comprises an internal cap (4) which can be removably applied on a neck (2) of a container (1). An external cap (5) is applied and constrained on the internal cap (4). The external cap (5) is free to move in an axial direction from a first position in which free rotation is possible between the external cap (5) and the internal cap (4) to second position in which the external cap (5) and the internal cap (4) are solid in rotation. The security strip (12) is made in a single piece with the internal cap (4) and is of annular shape with a V-section. When the capsule is mounted on the container, a free circumference (12*b*) of the security strip (12) engages with an annular projection (15) fashioned on the container (1). In a connection zone between the security strip (12) and the peripheral edge (4*a*) of the internal cap (4) there is a plurality of circumferential cuts (16), not conjoined, which occupy all of the connection zone.

5 Claims, 1 Drawing Sheet

CHILD-PROOF CAPSULE WITH SECURITY STRIP

TECHNICAL FIELD

The capsule is useful in all packaging where a child-proof opening is required.

BACKGROUND ART

The prior art comprises child-proof capsules in which the opening can be achieved only following a succession of coordinated movements which are difficult for a child below a certain age to perform.

These embodiments comprise an internal capsule, provided with means for connecting, normally of a screw-type, which enable the internal cap to be removably applied on a container, and an external cap which covers the internal cap when applied thereon. The external cap is constrained to the internal cap in such a way that there is freedom of rotation (a security situation known as child-proof) or solidarity of rotation with the internal cap according to distinct relative axial positions which the external cap can assume in relation to the internal cap. Child-proof capsules have existed for a considerable time in the prior art and on the market, which are provided with an easy-break security strip as proof of first opening, associated directly to the external cap of the capsule. One of the capsules is described in Italian patent IT 1.187.213 by the same applicant. This type of capsule, apart from requiring rather complex dies for its realisation, also exhibits the drawback of possible breakage of the easy-break ribs which keep the security strip joined to the external cap. Accidental pressure on the external cap, which can slide axially to activate the child-proof property, can also provoke a detachment of the security strip without the container being opened, or without there being any real intention to open the container.

There are other known types of child-proof capsule, which are however often assembled from a large number of individual pieces and therefore require the use of complex and expensive dies for their realisation.

The main aim in the manufacture of capsules in general, and in the realisation of the present capsule in particular, is to make realisation thereof ever-more economical, with embodiments that gradually reduce the number of separate pieces needed for their construction, using the simplest equipment possible, while not sacrificing working-life of the product and high productivity in its manufacture.

A further aim of the present invention is to provide a capsule of the child-proof kind which does not exhibit the risk of accidental breakage of the security strip. An advantage of the present invention is to provide a child-proof capsule made of only two parts.

This aim is achieved by the process of the invention, as it is characterised in the appended claims.

DISCLOSURE OF INVENTION

Further characteristics and advantages of the present invention will better emerge from the detailed description that follows of a preferred embodiment of the invention, illustrated purely by way of non-limiting example in the accompanying figures of the drawings, in which.

Figures 1, 2:
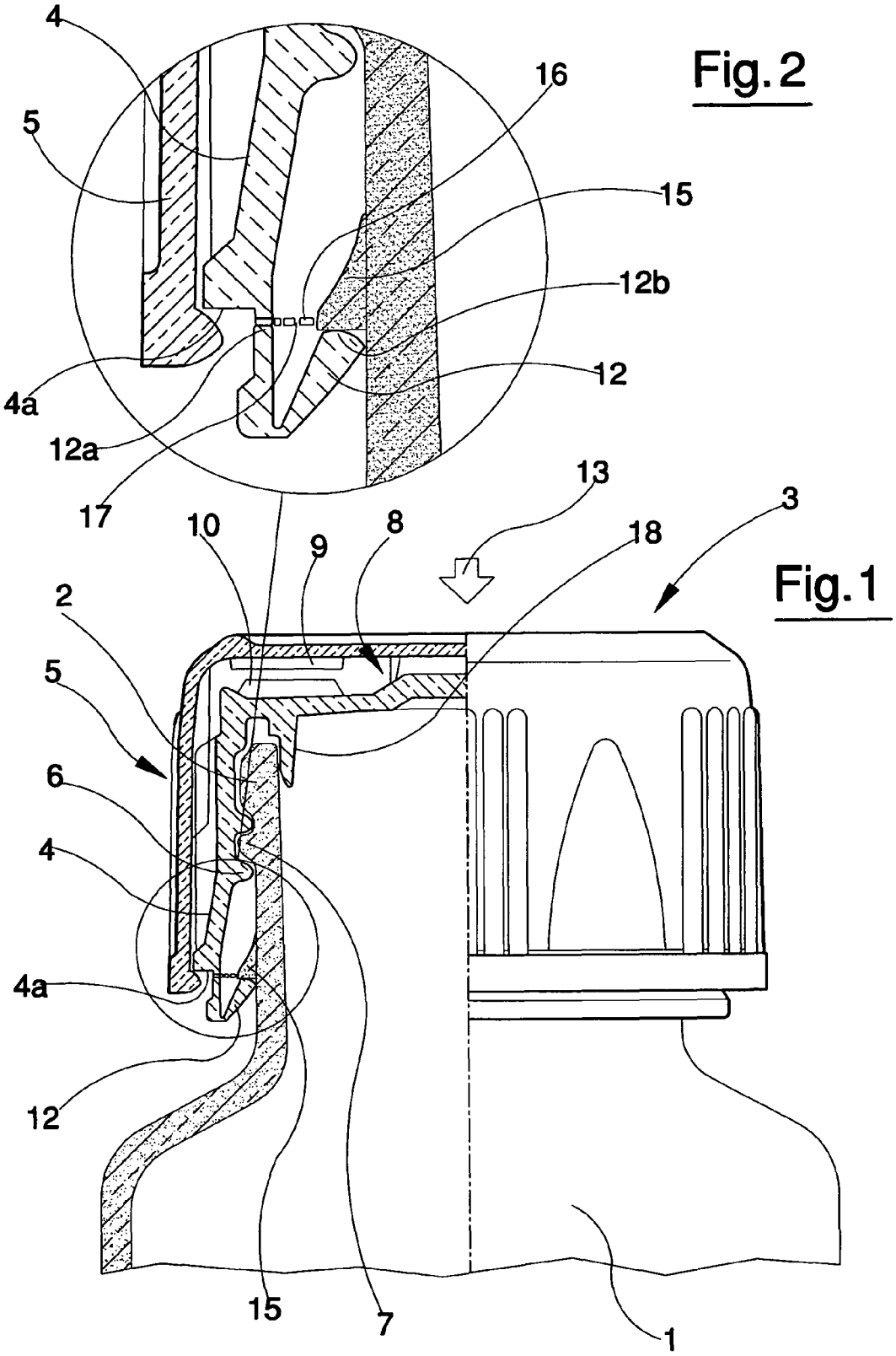
FIG. 1 is a partially sectioned view in vertical elevation of the invention.
FIG. 2 is a detail, in enlarged scale, of the capsule of FIG. 1.

With reference to the figures of the drawings, 1 denotes a container with a mouth and a neck 2, which is closed by means of the child-proof capsule 3 of the invention, comprising an internal cap 4 with an internal thread 6 for screwing onto a corresponding thread 7 fashioned on the neck 2 of the container 1. An external cap 5 is applied on the internal cap 4.

In the position illustrated in the figures of the drawings, i.e. the child-proof safety condition, the external cap 5 is in a first position, in which it is free to rotate about the internal cap 4. This position is achievable depending on the relative axial positions of the external cap 5 and the internal cap 4—a position which is maintained by means 8 which elastically keep the external cap 5 raised with respect to the internal cap 4.

When pressure is exerted in the direction indicated by the arrow 13 on the external cap 5, the external cap 5 moves downwards into a second position, not illustrated, and an internal cogging 9 fashioned on the upper part of the internal surface of the external cap 5 meshes with an external cogging 10 fashioned on the upper external surface of the internal cap 4. In this second position no reciprocal rotation can be achieved between the external cap 5 and the internal cap 4; it is therefore possible, by pressing on the external cap 5, to unscrew or screw the internal cap 4 from or onto the neck 2 of the container 1. The above description is also true of other childproof capsules of known type, like those disclosed in EP-A-0 963 916, EP-A-0 127 943, U.S. Pat. No. 5,676,268, U.S. Pat. No. 6,372,167.

The capsule of the invention comprises a security strip 12 which is made in a single piece with the internal cap 4, as an appendix on the peripheral edge 4*a* thereof facing the container 1.

The security strip 12 exhibits an annular shape with a V-section. There are therefore two circumferences of the security strip 12: a first circumference 12*a* of which is connected in a connection zone, with the peripheral edge 4*a* of the internal cap 4; and a second circumference 12*b* of which is free and engages, when the capsule is mounted on the container 1, with an annular projection 15 which is fashioned on the outside of the neck 2 of the container 1.

The connection zone between the security strip 12 and the peripheral edge 4*a* of the capsule exhibits a plurality of circumferential cuts, not joined together, which occupy the whole connection zone between the strip 12 and the peripheral edge 4*a* of the capsule. The cuts 16 are in fact mechanical incisions in the connection zone between the peripheral edge 4*a* of the capsule and the security strip 12 and are separated by uncut zones 17, of a thickness comprised between 0.1 and 1.0 mm.

In this way in the connection zone between the peripheral edge 4*a* of the capsule and the security strip an easy-fracture line (or rather a circumference) is created, which will break when stressed as will be better described hereinafter, and thus cause a detachment of the strip 12 from the internal cap 4.

Manufacture of the internal cap 4 and the security strip 12 in a single piece, having the above-described characteristics, can be done by press-forming and subsequent mechanical operations, for example following the process described in Italian patent IT 1.292.751. To this end the internal cap 4 with connected security strip 12 is made of a pressable plastic material.

The internal capsule 4 and the security strip 12 as above-described could, however, be made using other processes.

The capsule of the invention further comprises an annular projection 18 which is fashioned on the internal upper part of the internal cap 4 and is coaxial to the internal cap 4. The annular projection 18 is arranged so as to interfere, when the capsule is mounted on the container 1, with the internal wall of the neck 2 of the container 1; in this way the annular projection 18 guarantees sealed closure of the container 1 when the capsule is mounted thereon. This means that it is not necessary to include a seal, which in known capsules is constituted by a small disc which realises a "top" seal on the mouth of the container, and which is generally inserted either as an individual piece or as a pressure-glued element on the upper internal wall of the internal cap 4. Thus with the present invention an even greater reduction in the number of pieces needed is achieved, with a reduction in manufacturing and work times, as the annular projection 18, differently to the "top" seal, can be fashioned directly during the press-forming stage of the internal cap 4. Obviously, however, a normal "top" seal disc can be used, although it calls for use of a further and separate element.

The capsule of the invention, provided with the annular projection 18, is made in two pieces only, which are assembled by pressing the internal cap 4 into the external cap 5. If a seal disc is to be added, it is inserted or afforded internally of the internal cap 4 before the internal cap 4 is press-inserted into the external cap 5.

As mentioned herein above, in the position of FIG. 1 the external cap 5 is free to rotate about the internal cap 4, since the coggings 9 and 10 are not enmeshed. By exerting a pressure in the direction indicated by the arrow 13 on the external cap 5, the external cap 5 is axially downwardly displaced and the cogging 9 enmeshes with the other cogging 10. In this situation, as all relative rotation between the internal cap 4 and the external cap 5 is now inhibited, by screwing or unscrewing the external cap 5 the internal cap 4 will screw onto or unscrew from the neck 2 of the container 1.

On first opening of the container 1, the raising of the internal cap 4 causes contrast between the second free circumference 12*b* of the security strip and the annular projection 15 on the outside of the neck 2 of the container 1, causing the uncut zones 17 to break and the detachment of the security strip from the internal cap 4, signifying that the container 1 has been opened.

As the security strip is solidly constrained to the internal cap 4, an accidental pressure, which is not intended to break open the container 1, causes no stress on the uncut zones 17 and therefore no accidental detachment of the security strip. The strip can only be detached from the internal cap 4 when, after the external cap 5 is lowered, there is a deliberate rotation thereof causing the internal capsule 4 to unscrew from the neck 2, i.e. when there is a deliberate intention to open the container 1.

Thus with the capsule of the invention the aim of preventing accidental detachment of the security strip is achieved; also attained is the aim of making a manufacturing economy during construction of the capsule, which is obtained thanks to a limited number of pieces constituting the capsule and to the possibility of obtaining these pieces directly through press-forming and with relatively simple dies, thanks to the special shape of the internal cap 4.

The invention claimed is:

1. A child-proof capsule with a security strip, comprising an internal cap (4), provided with means for connecting which permit the internal cap (4) to be screwed onto and unscrewed off of a neck (2) of a container (1) and having external cogging (10) on an upper external surface of the internal cap (4), on which internal cap (4) an external cap (5) is arranged, which external cap (5) is provided with internal cogging (9) on an upper part of the internal surface of the external cap (5), which external cap (5) is constrained to the internal cap (4) with freedom to displace axially from (a) a first position, in which the internal cogging (9) and the external cogging (10) do not mesh with, each other, such that there is no contact between the internal cogging (9) and the external cogging (10) when the external cap (5) is rotated relative to the internal cap (4), to (b) a second position in which the internal cogging (9) and the external cogging (10) mesh with each other so that the external cap (5) and the internal cap (4) are reciprocally solid in rotation, wherein the security strip (12) is made in a single piece with the internal cap (4) as an appendix on a peripheral edge (4*a*) of the internal cap (4) facing the container (1) and a free circumferential edge (12*b*) of the security strip (12) engaging, when the capsule is mounted on the container (1), with a horizontal lower surface of an annular projection (15) fashioned on an outside of the neck (2) of the container (1), the security strip (12) being of an annular shape with a V-section and exhibiting, in a connection zone with the peripheral edge (4*a*) of the internal cap (4), a plurality of circumferential cuts (16), not joined together, which are spaced apart along the connection zone between the security strip (12) and the peripheral edge (4*a*) of the internal cap, the upper external surface of the internal cap (4) having an upward protrusion having a slanting shoulder, the capsule also comprising an elastic element (8) which comprises a protrusion which extends from the upper part of the internal surface of the external cap (5) and extends to and contacts said slanting shoulder in said first position so that the elastic element (8) elastically keeps the external cap (5) raised with respect to the internal cap (4) in said first position but which permits the external cap (5) to be axially displaced into said second position, the upper external surface of the internal cap (4) extending outwardly and substantially horizontally from the base of said slanting shoulder, to form a valley, and then slanting outwardly and upwardly to form a peak and then descending substantially vertically, the external cogging (10) being located in said valley, said external cap (5) having a bottom annular peripheral edge having an inwardly extending knob, the peripheral edge (4*a*) of the internal cap (4) having a widened lower portion immediately above said plurality of circumferential cuts (16), said widened lower portion having (a) a horizontal lower surface forming a roof, (b) an external sidewall extending vertically from the distal edge of the horizontal lower surface, and (c) a slanting shoulder extending inwardly and upwardly from the top of said vertical sidewall, an external wall of the peripheral edge (4*a*) of the internal cap (4) slanting inwardly and upwardly from the slanting shoulder, said inwardly extending knob of the external cap (5) extending underneath said roof, said security strip (12) comprising a first circumference (12*a*) and said free circumferential edge (12*b*), said first circumference (12*a*) having an upper portion and a lower portion, said upper portion having a vertical exterior wall, said lower portion being substantially thicker than said upper portion and extending outwardly with respect to said upper portion, said free circumferential edge (12*b*) becoming progressively wider as it extends inwardly and upwardly from the bottom of the first circumference (12*a*), the distal end of the free circumferential edge (12*b*) being rounded where it engages the horizontal lower surface of the annular projection (15).

2. The capsule of claim 1, wherein the circumferential cuts (16) are constituted by mechanical incisions in the connection zone between the peripheral edge (4*a*) of the internal cap (4) and the security strip (12).

3. The capsule of claim 2, wherein the circumferential cuts (16) are separated by uncut zones (17) having a breadth of between 0.1 and 1.0 millimeters.

4. The capsule of claim 1, further comprising an annular projection (18), coaxial with the internal cap (4) and fashioned on an upper internal part thereof, which interacts with an internal wall of the neck (2) of the container (1) when the capsule is mounted on the container (1), said annular projection (18) having a proximal portion and a distal portion, the distal portion being about ½ the thickness of the proximal portion and tapering as it approaches the distal tip, annular projection (18) having a substantially vertical inner surface.

5. The capsule of claim 1, wherein the internal cap (4) is made of a plastic material which is susceptible to press-forming.

* * * * *